US007654241B2

(12) United States Patent
Kobayashi et al.

(10) Patent No.: US 7,654,241 B2
(45) Date of Patent: Feb. 2, 2010

(54) DUAL-CHAMBER TYPE OIL PAN AND ENGINE EQUIPPED WITH SAME

(75) Inventors: Hideo Kobayashi, Mishima (JP); Katuhiko Arisawa, Gotenba (JP); Yoshio Yamashita, Susono (JP); Kunihiko Hayashi, Ashigarakai-gun (JP); Tametoshi Mizuta, Susono (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 110 days.

(21) Appl. No.: 11/885,849

(22) PCT Filed: Mar. 6, 2006

(86) PCT No.: PCT/JP2006/004813

§ 371 (c)(1),
(2), (4) Date: Sep. 7, 2007

(87) PCT Pub. No.: WO2006/095880

PCT Pub. Date: Sep. 14, 2006

(65) Prior Publication Data

US 2008/0066982 A1 Mar. 20, 2008

(30) Foreign Application Priority Data

Mar. 8, 2005 (JP) ..... 2005-064362

(51) Int. Cl.
*F02B 77/00* (2006.01)

(52) U.S. Cl. ..... 123/195 C; 184/104.2

(58) Field of Classification Search ..... 123/195 C, 123/196 R, 196 AB; 184/6.2, 6.5, 6.22, 104.1, 184/104.2

See application file for complete search history.

(56) References Cited

U.S. PATENT DOCUMENTS

| | | | |
|---|---|---|---|
| 4,258,679 | A | 3/1981 | Leitermann |
| 2003/0029412 | A1 | 2/2003 | Kato et al. |

FOREIGN PATENT DOCUMENTS

| | | | |
|---|---|---|---|
| DE | 3235292 | | 3/1984 |
| JP | 2001-152825 | A | 6/2001 |
| JP | 100 02 256 | A1 | 8/2001 |
| JP | 2003-222012 | A | 8/2003 |
| JP | 2003-278519 | A | 10/2003 |

*Primary Examiner*—Noah Kamen
(74) *Attorney, Agent, or Firm*—Sughrue Mion, PLLC

(57) ABSTRACT

A dual-chamber oil pan includes an oil pan provided below an engine block, an oil pan separator that is provided within the oil pan and defines a first chamber communicating with the engine block, and a second chamber provided around the first chamber, and a suction port disposed within the first chamber. The first chamber includes a large-capacity portion including a bottom portion of the oil pan separator, and a small-capacity portion located above and integrally formed with the large-capacity portion.

17 Claims, 10 Drawing Sheets

DUAL-CHAMBER TYPE OIL PAN AND ENGINE EQUIPPED WITH SAME

TECHNICAL FIELD

The present invention relates to an oil pan that is disclosed under an engine block and stores engine oil.

BACKGROUND ART

Conventionally, engine oil is used to lubricate and cool the engine. The engine oil is stored in an oil pan disposed under the engine and is circulated through individual parts of the engine by an oil pump. The engine oil circulated through the individual parts drops into the oil pan located below these parts. The engine oil dropped into the oil pan is recirculated through the individual parts by the oil pump. During the circulation, the engine oil receives heat from the individual parts of the engine and cools them. The engine oil also acts to form oil films in the individual parts of the engine, thereby promoting lubrications among the parts, preventing the parts from oxidizing, and so forth.

Immediately after the engine is started in a cold state, the engine oil stored in the oil pan is cold and has a high viscosity, so that the engine oil is not in a state suitable for circulating through the individual parts of the engine and lubricating them. It is thus desired to raise the temperature of the engine oil as soon as possible immediately after the cold start and to have an appropriate viscosity. To this aim, it has been proposed to divide an oil pan into multiple sections, so as to prepare a state where the engine oil within one of the sections is likely to circulate immediately after the cold start, and heat the engine oil within this section earlier, while to prevent the engine oil from being excessively heated after the completion of warming up and place the engine oil in a favorable state (See Documents 1 through 3 identified later). The early temperature rise of the engine oil contributes improvements in fuel economy due to early reduction in friction, and is desired in terms of recent strong demands for fuel economy.

FIG. 1 is a cross-sectional view of a dual-chamber type oil pan 50 disclosed in Document 1 (Japanese Patent Application Publication 2003-222012). The dual-chamber oil pan 50 has an oil pan separator 51 having a recess portion 51*a* in an oil pan 52 in order to efficiently raise the temperature of engine oil. An oil strainer 53 is arranged so that a port 53*a* for sucking the engine oil is positioned in the recess portion 51*a*. Communication holes 54 and 55 are respectively provided in upper and lower portions of a sidewall 51*a*1 of the recess portion 51*a* so that the inside and outside of the sidewall 51*a*1 of the recess portion 51*a* can communicate with each other. The communication hole 55, which is provided in the lower portion of the sidewall 51*a*1 of the recess portion 51*a*, controls circulation of the engine oil through the sidewall 51*a*1 of the recess portion 51*a* by utilizing variations in the viscosity of the engine oil. More specifically, the communication hole 55 is designed to have a small diameter, which functions as a high circulation resistance for the engine oil having a high viscosity when the engine is in the warmed-up state. It is thus impossible to mix the engine oils located inside and outside of the sidewall 51*a*1 with each other through the communication hole 55. In contrast, the engine oil having a low viscosity after warming up can pass through the communication hole 55, so that the engine oils located inside and outside of the sidewall 51*a*1 of the recess portion 51*a* can be mixed with each other. This mixing causes the engine oil having a low temperature positioned outside of the recess portion 51*a* to cool the engine oil in the recess portion 51*a* having a high temperature.

The communication hole 54, which is provided in the upper portion of the sidewall 51*a*1 of the recess portion 51*a*, is capable of circulating the engine oil between the inside and outside of the sidewall 51*a*1 irrespective of the viscosity of the engine oil. The communication hole 54 mainly functions to flow the engine oil that has been circulated through the individual parts of the engine and dropped into the oil pan separator 51 (within the recess portion 51*a*) to the outside of the sidewall 51*a*1. Thus, a circulation route of the engine oil indicated by arrows 57 can be formed in which the engine oil flowing out of the upper portion of the recess portion 51*a* flows in the recess portion 51*a* again through the lower portion of the recess portion 51*a* on the basis of the viscosity of the engine oil. The circulation route of the engine oil facilitates mixing and cooling of the engine oil. The mixed engine oil is sucked from the suction port 53*a*, and is supplied to the inside of the engine block 56. A drain plug 58 is attached to the oil pan 52.

Document 2 (Japanese Patent Application Publication No. 2003-278519) discloses an oil pan structure in which the inside of an oil pan is divided into two oil reservoirs by a separate plate. The upper end of the separate plate is located so as to be lower than the oil level. The separate plate has a communication passage for making a communication between the two reservoirs, and a valve for opening and closing the communication passage in accordance with variations in the temperature of the oil in the oil pan. In the above oil pan structure, only one of the two oil reservoirs is equipped with the suction port of an oil pipe, and only oil in the oil reservoir associated with the suction port is used when the oil is at a low temperature. It is thus possible to quickly raise the temperature of the oil in the oil pan. When the oil temperature rises and the valve is brought in the open state, the two oil reservoirs are allowed to communicate with each other, and the oils in the oil reservoirs are circulated through the individual parts of the engine. The two oil reservoirs always communicate with each other above the top end of the separate plate, and are kept at an identical level.

Document 3 (Japanese Patent Application Publication No. 2001-152825) discloses an oil pan of the engine, which is divided into first and second oil reservoirs by a segment plate. A vertical sidewall of the segment plate has a communication hole via which the first and second oil reservoirs communicate with each other. A first valve is provided which releases the communication hole when the amount of oil in the first reservoir becomes lower than a given level. A second valve is provided which releases the communication hole when the temperature of the oil in the first reservoir becomes higher than a given temperature. The end of the oil strainer, that is, the suction port is located in the first oil reservoir. When the temperature of the engine oil in the first reservoir is low, this oil is used for circulation. It is thus possible to facilitate the temperature rising of a small amount oil in the first oil reservoir. When the amount of the oil in the first oil reservoir becomes lower than the given level, the first and second oil reservoirs are caused to communicate with each other, so that oil shortage can be avoided.

DISCLOSURE OF THE INVENTION

Problems to be Solved by the Invention

As described above, the dual-chamber oil pan 50 disclosed in Document 1 is designed to have the oil pan 52 divided into multiple chambers and facilitate the oil in only one of the chambers immediately after the cold start. It is thus possible to quickly raise the temperature of the oil in the chamber involved in the cold start and improve fuel economy. However, the dual-chamber oil pan 50 still has room for improvement directed to more efficiently raising the temperature of the engine oil immediately after the cold start and much more improving fuel economy.

The oil pans disclosed in Documents 2 and 3 are capable of quickly raising the oil temperature. However, the two oil reservoirs in the oil pan structure disclosed in Document 2 are arranged in the segmented state in the front-to-rear or left-to-right direction of the oil pan. Similarly, the first and second oil reservoirs of the oil pan disclosed in Document 3 are arranged in the segmented state in the front-to-rear or left-to-right direction of the oil pan. Thus, the oil reservoir that stores oil used when the oil is cold is exposed to traveling wind. Therefore, the oil pans mentioned above have room for improvement in terms of thermal insulation of oil.

It is an object of the present invention to provide a dual-chamber oil pan capable of more efficiently raising the temperature of the engine oil at the time of cold start and much more improving fuel economy and to provide an engine equipped with the same.

Means for Solving the Problems

According to an aspect of the present invention, there is provided a dual-chamber oil pan including: an oil pan provided below an engine block; an oil pan separator that is provided within the oil pan and defines a first chamber communicating with the engine block, and a second chamber provided around the first chamber; and a suction port disposed within the first chamber, the first chamber including a large-capacity portion including a bottom portion of the oil pan separator, and a small-capacity portion located above and integrally formed with the large-capacity portion.

At the time of a cold start, engine oil in the first chamber is circulated through the engine. Thus, the temperature of the engine oil may rise quickly as a small amount of engine oil is in the first chamber. However, if the amount of engine oil in the first chamber is too small, the oil level decreases by suction of the engine oil by a pump, and air may be sucked through the suction port. In addition, a sufficient oil pressure may not be secured. Particularly, the engine oil has a high viscosity at the time of the cold start, and the engine oil supplied to the engine block adheres to the inner wall of the engine block and has a difficulty in returning to the first chamber. Thus, the engine oil in the first chamber is likely to be consumed promptly. When the vehicle is quickly turned or starts to go up a slope with a reduced amount of engine oil being stored in the first chamber, there is an increased possibility that air may be sucked through the suction port.

With the above in mind, according to an aspect of the present invention, the first chamber is provided with the small-capacity portion, which makes it possible for the first chamber to store a small amount of engine oil. Thus, the temperature of the engine oil in the first chamber can be raised quickly. Further, the first chamber is provided with the large-capacity portion, so that the minimum amount of engine oil can be secured.

The engine oil in the first chamber of the dual-chamber oil pan is mainly used for circulation. Thus, even when much engine oil in the first chamber is supplied to the engine block and only a small amount of engine oil remains in the oil pan, it is desired that much remaining engine oil remains in the first chamber. It is thus preferable that the small-capacity portion is provided above the large-amount portion. With this arrangement, it becomes difficult for the suction port to be exposed from the engine oil, so that the dangerous possibility of suction of air through the suction port can be reduced.

The relationship between the large-capacity portion and the small-capacity portion may be defined by the relationship between the oil level areas therein. More specifically, the large-capacity portion has a large oil level area than that of the small-capacity portion.

The small-capacity portion may have a constricted portion that is connected to an opening provided in an upper portion of the large-capacity chamber and extends upwards. The engine oil enters into the large-capacity portion through the opening. Although the constricted portion is required to be narrower than the outer diameter of the large-capacity portion, it is not limited to have a particular position or shape. For example, the small-capacity portion may have a hollow cylindrical portion that is connected to an opening provided in an upper portion of the large-capacity chamber and extends upwards. The oil pan separator may include an oil receiving portion that extends from the small-capacity portion to an upper end of the oil pan. The oil receiving portion receives engine oil dropped from the inside of the engine block. The oil receiving portion also functions as a connecting portion which joins the oil pan separator and the oil pan at an upper end of the oil pan. The oil pan separator may include an oil receiving portion includes a down slope portion that extends from the small-capacity portion to an upper end of the oil pan. The down slop portion guides the engine oil dropped from the inside of the engine block to the first chamber.

The small-capacity portion may have a constricted portion that is a slope portion of the oil pan separator extending from the opening of the large-capacity chamber.

The oil pan separator may have a shoulder portion located above the large-capacity portion. The shoulder portion realizes such a relationship that the oil level area in the large-capacity portion is greater than that of the small-capacity portion. The shoulder portion may extend outwards from the small-capacity portion. The shoulder portion may be at least a part of an upper portion of the large-capacity chamber.

The dual-chamber oil pan may further include an oil port provided in a shoulder portion of the large-capacity portion, and an oil valve closing the oil port as an oil level in the first chamber becomes high. The above oil port is used to evenly supply the engine oil to the first and second chambers at the time of oil exchange. The oil valve may have a shape including a flange that is provided to the upper end of a rod penetrated through the oil port and receives oil pressure. When the flange receives oil pressure from the lower side, the oil valve is lifted and opens the oil port. The oil valve may be provided to the shoulder portion, and a resultant space allows the oil valve to be lifted.

Preferably, the dual-chamber oil pan may be configured so that the small-capacity chamber is located at a level higher than a minimum oil level of the oil pan. The large-capacity chamber may have a portion located at a level higher than a minimum oil level of the oil pan. The large-capacity portion has a comparatively large oil level area, so that the oil level can be gradually lowered as the engine oil is sucked through the suction port. The speed at which the oil level becomes close to the suction port can be reduced, and the dangerous possibility that air may be sucked through the suction port can be reduced.

The oil pan separator includes a narrowed portion integrally formed with a lower portion of the large-capacity portion, and the suction port is disposed to the narrowed portion. The narrowed portion has a small oil storage capacity, and further reduces the amount of engine oil in the first chamber. It is thus possible to more quickly raise the temperature of the engine oil. Even when the first chamber has a reduced storage capacity of engine oil, a sufficient distance between the oil level and the suction port can be secured by disposing the suction port within the narrowed portion, so that the dangerous possibility that air may be sucked through the suction port can further be reduced.

The dual-chamber oil pan may be configured so that the oil pan separator includes a first communication hole located in the small-capacity chamber, and a second communication hole located in the large-capacity chamber. The first communication hole may be located at a level lower than the oil level defined when almost the all engine oil has returned to the oil pan, and allows the engine oil to be exchanged between the first and second chambers. When the oil level becomes lower than the first communication hole, which is thus exposed, the engine oil is no longer exchanged between the first and second chambers. However, since the second communication hole is located in the large-capacity chamber, preferably, in a bottom portion of the oil pan separator or its vicinity, the first and second chambers always communicate with each other. This enables the engine oil to remain in the first chamber, and improves reliability. Preferably, the second communication hole is away from the suction port as much as possible in order to prevent cold engine oil in the second chamber from sucked at the time of cold start.

The engine oil can be efficiently drawn from the first chamber at the time of oil exchange because the second communication hole is preferably located in the bottom portion of the oil pan separator or the vicinity thereof. The second communication hole may be provided in the lower portion of the large-capacity portion in the absence of the above-mentioned narrowed portion, and may be provided in the lower portion of the narrowed portion in the presence thereof.

The dual-chamber oil pan may further include: a first thermostat attached to the oil pan separator so as to face a temperature sensitive portion thereof faces the engine block; and a second thermostat attached to the oil pan separator so as to face a temperature sensitive portion thereof faces the first chamber. The first and second thermostats may be employed instead of the first and second communication holes. The first and second thermostats may be closed and the first and second chambers are isolated from each other when the engine oil is at a low temperature. When the temperature of the engine oil becomes high, the first and second thermostats are opened so that the engine oil can be exchanged between the first and second chambers. It is thus possible to prevent the temperature of the engine oil from excessively rising.

The dual-chamber oil pan may further include an oil passage formed between the oil pan separator and the oil pan. For instance, the oil pan that defines the outer shape of the dual-chamber oil pan may be shaped so that the oil pan is close to a portion of the oil pan separator that defines the large-capacity chamber. The close arrangement defines an oil passage. Preferably, the cold engine oil in the second chamber should be prevented from entering into the first chamber at the time of cold start in order to raise the temperature of the engine oil in the first chamber as quickly as possible. In addition, the engine oil in the dual-chamber oil pan should be circulated well through the first and second chambers after the completion of warming up in order to avoid excessive heating of engine oil. The above-mentioned oil passage facilitates circulation of the engine oil, and effective cooling effects can be obtained by utilizing traveling wind. The oil passage allows not only a horizontal flow of oil on the bottom of the oil pan but also a vertical flow. This realizes efficient cooling.

The dual-chamber oil pan may further include a plate provided above the suction port. A spiral flow is caused above the suction port, and shapes the oil level into an inverted conical shape. When the oil level is lowered, the dangerous possibility of sucking air becomes higher. The plate reduces the change of the oil level caused when the engine oil in the first chamber is sucked through the suction port.

EFFECTS OF THE INVENTION

As described above, according to the present invention, the first chamber is allowed to have a small amount of engine oil, so that the temperature of the engine oil can be raised quickly at the time of cold start. The large-capacity portion is provided below the small-capacity portion, so that air can be effectively prevented from being sucked through the suction port even when the engine oil has a high viscosity and a difficulty in returning to the oil pan from the engine block, and a reduced amount of engine oil remains in the first chamber.

BRIEF DESCRIPTION OF THE DRAWINGS

FIGS. 4A and 4B show a process of producing an oil pan separator used in the dual-chamber oil pan of the first embodiment, wherein FIG. 4A shows the oil pan separator divided into two, and FIG. 4B shows the two divided parts are joined together to form the oil pan separator;

BEST MODES FOR CARRYING OUT THE INVENTION

A description will now be given, with reference to the accompanying drawings, of embodiments of the present invention.

First Embodiment

Figure 1:
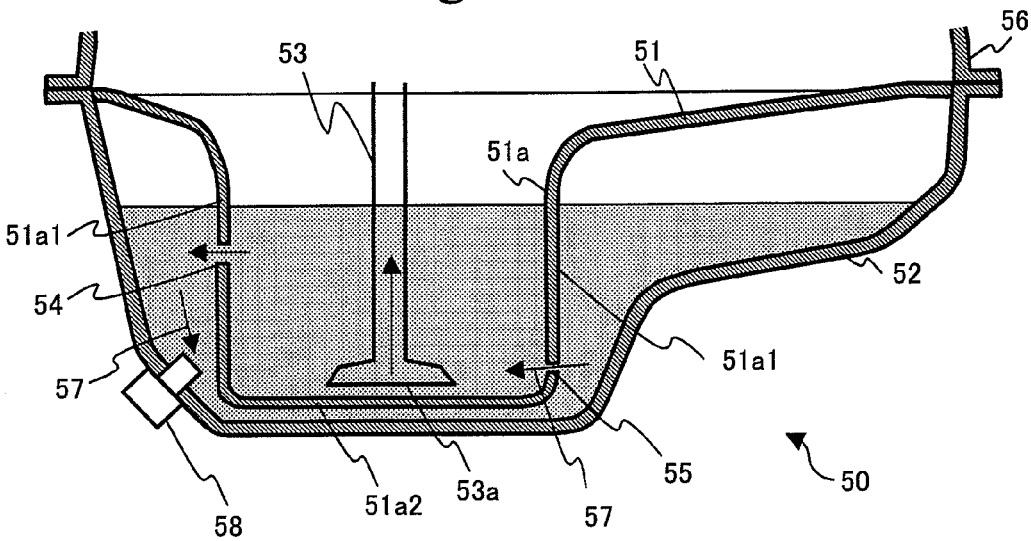
Fig.1 PRIOR ART
FIG. 1 is a cross-sectional view of a conventional dual-chamber oil pan.
Figure 2:
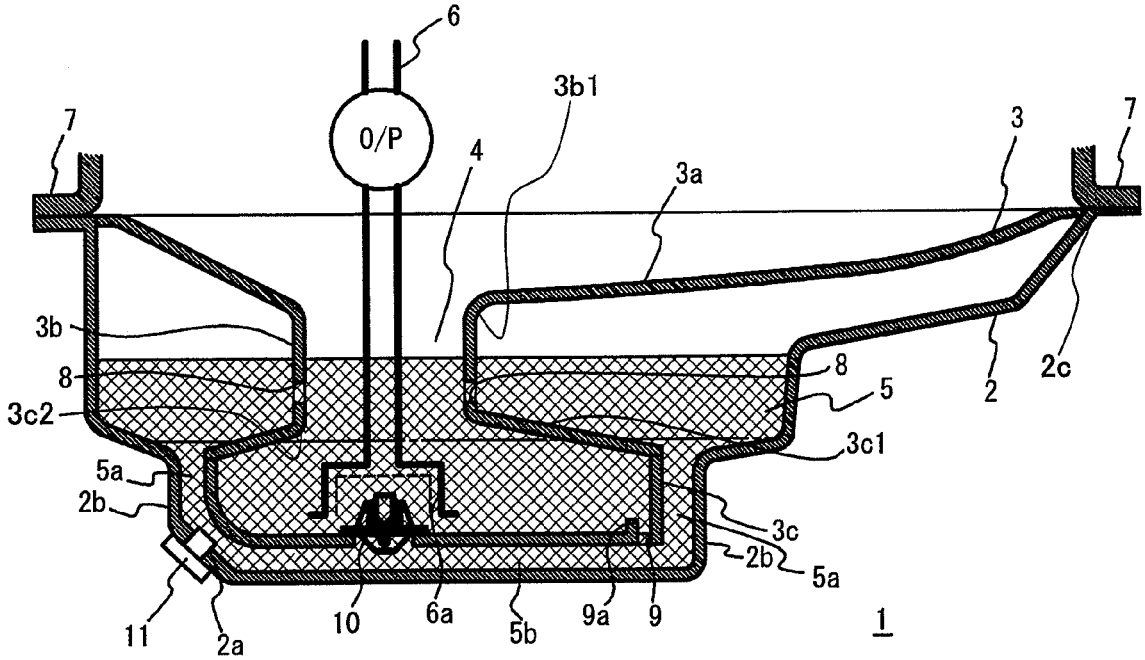
FIG. 2 is a cross-sectional view of a dual-chamber oil pan according to a first embodiment of the present invention in which engine oil is up to a given level.
Figure 3:
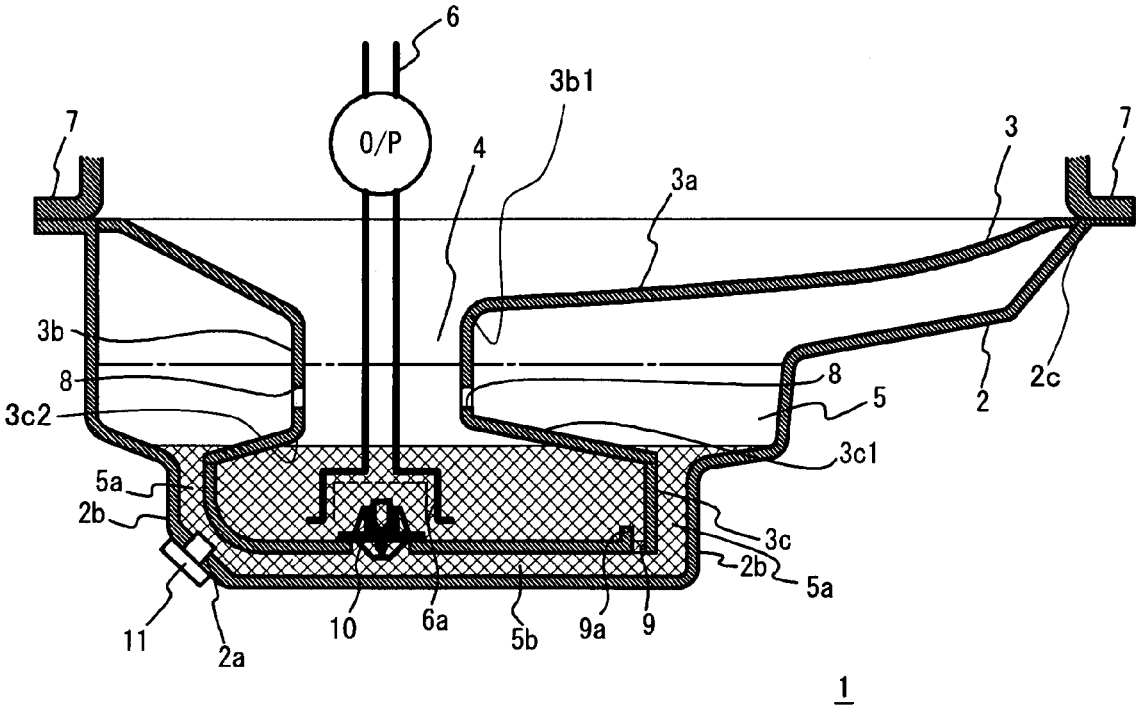
FIG. 3 is a cross-sectional view of the dual-chamber oil pan according to the first embodiment in which engine oil stored is reduced.

A dual-chamber oil pan in accordance with a first embodiment of the present invention will now be described. FIGS. 2 and 3 are respectively cross-sectional views of a dual-chamber oil pan 1 in according with the first embodiment of the present invention. More specifically, FIG. 2 shows a state in which engine oil stored is up to a given level prior to engine start, and FIG. 3 shows another state in which some engine oil has been supplied to an engine block 7 from the dual-chamber oil pan 1 and the remaining engine oil in the dual-chamber oil pan 1 is thus reduced. The dual-chamber oil pan 1 is attached to a lower portion of the engine block 7, and is equipped with an oil pan separator arranged within an oil pan 2. The oil pan separator 3 defines a first chamber 4 and a second chamber 5 within the oil pan 2. The first chamber 4 communicates with the inside of the engine block 7. The second chamber 5 is arranged so as to cover or surround the first chamber 4, and is located around the first chamber 4.

The first chamber 4 includes a large-capacity portion 3*c* arranged on the bottom side of the oil pan separator 3, and a small-capacity portion 3*b* that is provided above the large-capacity portion 3*c* and communicate therewith. The large-capacity portion 3*c* has a larger volume than the small-capacity portion 3*b*. This volume relationship may be realized by making the oil level area in the large-capacity portion 3*c* greater than that in the small-capacity portion 3*b*. This relationship in the oil level area may be defined so that the oil pan separator 3 has a shoulder portion in an upper portion of the large-capacity portion 3*c*. The shoulder portion 3*c*1 may be formed along the entire circumference of the upper portion of the large-capacity portion 3*c*. The small-capacity portion 3*b* forms a constricted portion, which is integrally formed with an opening 3*c*2 formed in the upper portion of the large-capacity portion 3*c*. The constricted portion, namely, the small-capacity portion 3*b* is a hollow cylindrical portion that is connected to the opening 3*c*2 of the large-capacity portion 3*c* and extends upwards, as shown in FIGS. 2 and 3. The oil pan separator 3 has an oil receiving portion 3*a*, which extends from an upper end 3*b*1 of the small-capacity portion 3*b* having the hollow cylindrical shape to a circumferential upper end 2*c* of the oil pan 2. The oil receiving portion 3*a* has a down slope that extends from the circumferential upper end 2*c* of the oil pan 2 to the upper end 3*b*1 of the small-capacity portion 3*b*. The down slope causes the oil dropped from the engine block 7 to efficiently flow in the first chamber 4. The oil pan separator 3 thus formed defines a small internal capacity due to the presence of the small-capacity portion 3*b*, as compared to the conventional oil pan separator.

A suction port 6*a* of an oil pan separator 3 is disposed in the first chamber 4. More specifically, the suction port 6*a* is located in the large-capacity portion 3*c*. The suction port 6*a* has a cap shape, as shown in FIG. 2. A temperature sensing portion of a thermostat 10 attached to the oil pan separator 3 is located within the cap-shaped suction port 6*a*.

A first communication hole 8 is formed in the small-capacity portion 3*b*. A second communication hole 9 is formed in the bottom of the large-capacity portion 3*c*. The second communication hole 9 functions to communicate the first chamber 4 and the second chamber 5 with each other. In order to prevent much engine oil in the second chamber 5 from being sucked when the engine oil is sucked through the suction hole 6*a*, the second communication hole 9 is located at a corner of the large-capacity portion 3*c*, and is equipped with a barrier wall 9*a* located along an edge of the second communication hole 9.

A oil drain 2*a* is attached to the oil pan 2, and a drain plug 11 is loaded thereto. As shown in FIG. 2, the oil pan 2 is formed so that a lower side plate portion 2*b* is close to the large-capacity portion 3*c* of the oil pan separator 3, that is, the wall of the oil pan separator 3 is close to the wall of the oil pan 2. This close arrangement results in an engine oil passage 5*a* in the second chamber 5. The engine oil passage 5*a* communicates with a lower engine oil passage 5*b*. The engine oil can be circulated between the first chamber 4 and the second chamber 5 through the first communication hole 8, the engine oil passage 5*a*, the engine oil passage 5*b* and the thermostat 10. This circulation is capable of efficiently cooling engine oil.

The dual-chamber oil pan 1 is in the state shown in FIG. 2 before the cold start in which the engine oil stored is up to the given level. When the engine is started in the state shown in FIG. 2, the engine oil in the first chamber 4 is sucked through the suction port 6*a*, and is supplied to the engine block 7. Then, the engine oil in the first chamber 4 is gradually reduced, and the oil level is gradually lowered.

At the time of cold start, the engine oil has a high viscosity, and has a difficulty in returning to the first chamber 4. Thus, the reduced amount of engine oil in the first chamber 4 during the cold start is greater than that after the engine is warmed up. The reduction of engine oil in the oil pan 2 may cause the first communication hole 8 to be exposed from the oil level, as shown in FIG. 3. However, the first chamber 4 and the second chamber 5 constantly communicate with each other through the second communication hole 9. It is thus possible to secure a sufficient amount of engine oil to keep the suction port 6*a* located within the engine oil.

When the oil level becomes close to the large-capacity portion 3*c*, as shown in FIG. 3, the change of the oil level height, that is, the rate of reduction in the oil level becomes slow because the large-capacity portion 3*c* has a large oil level area. That is, the change of the oil level is not greatly sensitive to the change of the amount of engine oil. It is thus possible to prevent air from being sucked through the suction port 6*a*.

It is to be noted that the first chamber 4 is designed to store a smaller amount of engine oil than that in the conventional chamber so that a small amount of engine oil is likely to remain, nevertheless it has a less dangerous possibility that air may be sucked through the suction port 6*a* due to the presence of the above-mentioned mechanism for preventing air from being sucked through the suction port 6*a*. The smaller amount of engine oil in the first chamber 4 raises the oil temperature more quickly after the cold start, so that the frictions caused against the individual parts of the engine can be reduced and fuel economy can be improved.

As shown in FIG. 2, the large-capacity portion 3*c* is equipped with the shoulder portion 3*c*1 that functions as a baffle plate. The shoulder portion 3*c*1 prevents the oil level from being inclined and thus prevents air from being sucked through the suction port 6*a*.

After the temperature of the engine oil in the first chamber 4 reaches an appropriate temperature, the thermostat 10 opens and the engine oil is actively sucked from the second chamber 5. Thus, the entire engine oil in the dual-chamber oil pan 1 is circulated. After the engine is warmed up, a large amount of engine oil is circulated through the engine oil passages 5*a* and 5*b*, so that the temperature of the engine oil can be prevented from rising excessively.

Figure 4A:
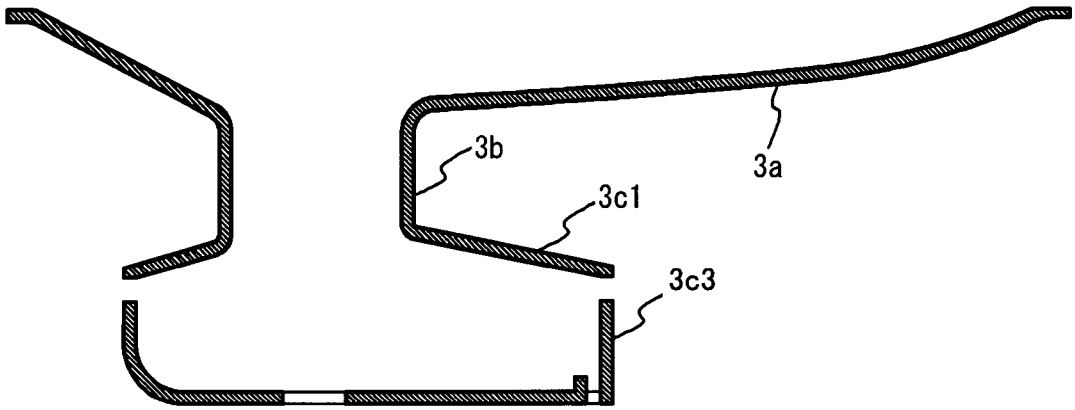
Figure 4B:
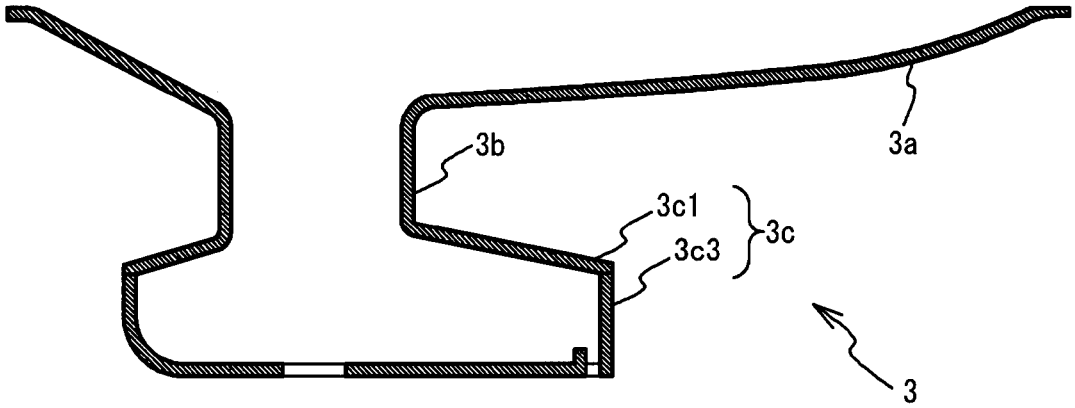

A description will now be given of a process of shaping into the oil pan separator 3 for the dual-chamber oil pan 1. The oil pan separator 3, which may be made of resin, defines the small-capacity portion 3*b* and the large-capacity portion 3*c* provided below the portion 3*b*. It may be difficult to integrally form the small-capacity portion 3*b* and the large-capacity portion 3*c* with resin. Taking the above into consideration, the oil pan separator 3 may be composed of two separate members, as shown in FIG. 4A. A single-piece member has the oil receiving portion 3*a*, the small-capacity portion 3*b* and the shoulder portion 3*c*1 of the large-capacity portion 3*c*. Another single-piece member has a lower portion 3*c*3 of the large-capacity portion 3*c*. These members are joined together, as shown in FIG. 4B, so that the oil pan separator 3 can be completed.

Second Embodiment

Figure 5:
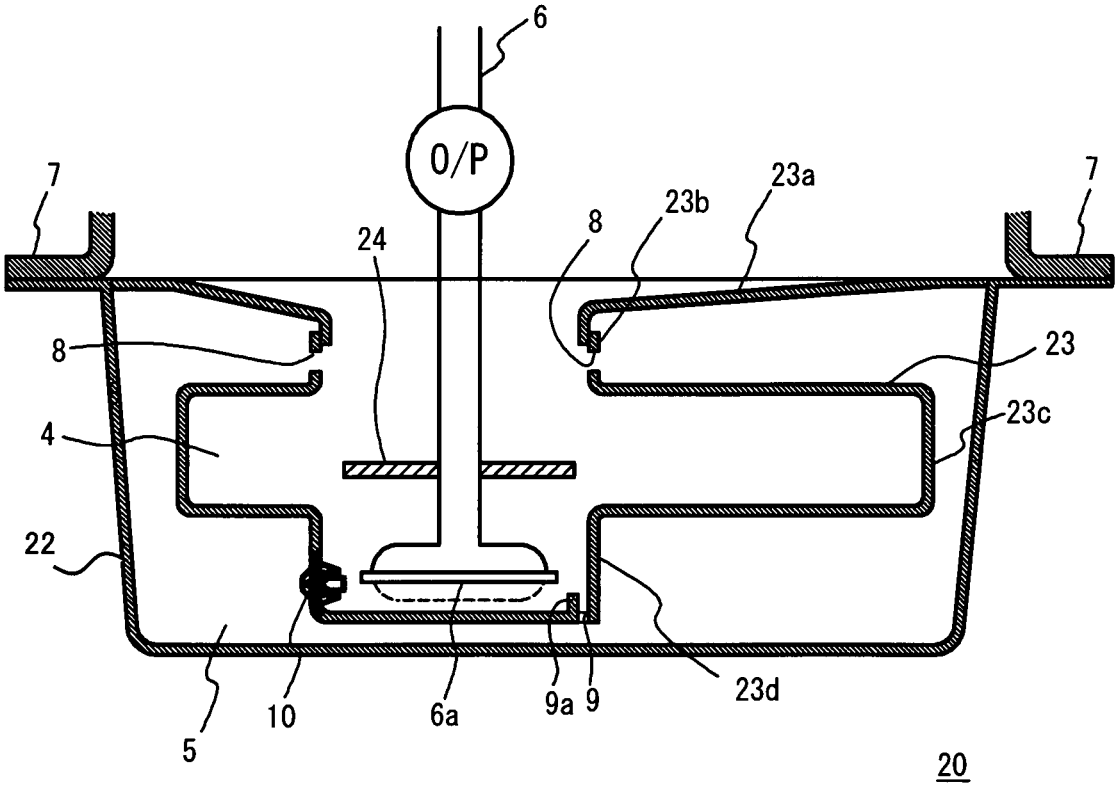
FIG. 5 is a cross-sectional view of a dual-type oil pan according to a second embodiment of the present invention.
Figure 6:
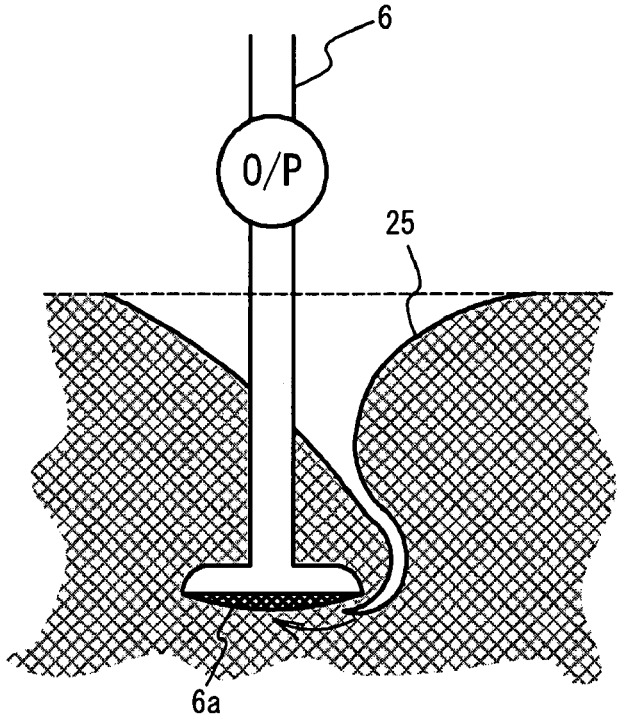
FIG. 6 schematically shows a change of the oil level observed in the absence of a plate.
Figure 7:
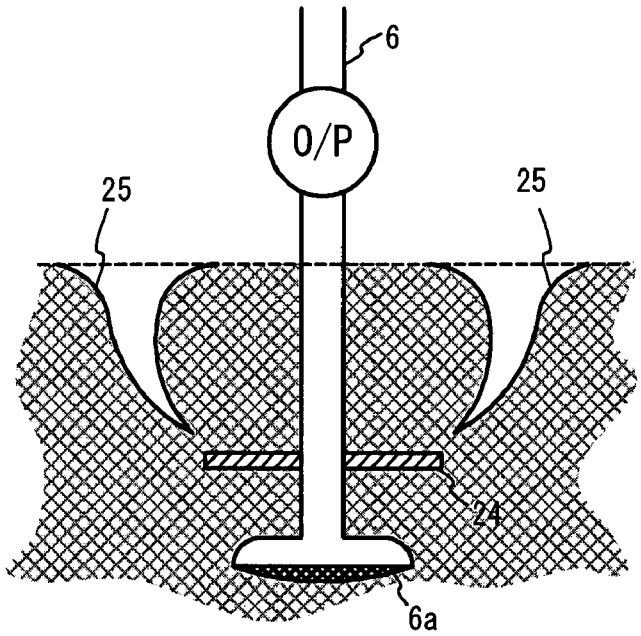
FIG. 7 schematically shows a change of the oil level observed in the presence of a plate.

A description will now be given, with reference to FIGS. 5 through 7, of a second embodiment of the present invention. A dual-chamber oil pan 20 in accordance with the second embodiment differs from the dual-chamber oil pan 1 of the first embodiment as follows. An oil pan separator 23 provided in an oil pan 22 of the dual-chamber oil pan 20 has a narrowed portion 23*d* in addition to an oil receiving portion 23*a*, a small-capacity portion 23*b* and a large-capacity portion 23*c* as those of the oil pan separator 3 of the dual-chamber oil pan 1. The suction port 6*a* is disposed within the narrowed portion 23*d*. Further, an eaves-like plate 24 is provided above the suction portion 6*a*.

In the dual-chamber oil pan 20 thus structured, the suction port 6*a* may be placed more deeply than that in the dual-chamber oil pan 1 of the first embodiment by a depth equal to the length of the narrowed portion 23*d*. This structure secures an increased distance between the oil level and the suction port 6*a*, and further reduces the dangerous possibility that air may be sucked from the suction port. Preferably, the narrowed portion 23*d* has a necessary and minimum volumetric capacity in order to avoid an increase in the amount of engine oil in the first chamber 4.

The use of the plate 24 is a further measure against sucking air. The effects of the plate 24 will now be described with reference to FIGS. 6 and 7. FIG. 6 schematically illustrates an oil level 25 observed in the absence of the plate 24. A spiral flow is caused above the suction port 6*a*, and shapes the oil level 25 into an inverted conical shape. When the oil level is lowered, the dangerous possibility of sucking air becomes higher.

In contrast, the plate 24 provided above the suction port 6*a* reduces the change of the oil level caused when the engine oil in the first chamber 4 is sucked through the suction port 6*a*. That is, the engine oil flows into the suction port 6*a* along a passage that bypasses the plate 24. Thus, the change of the oil level 25 can be greatly reduced, and it is thus possible to suppress the occurrence of the spiral flow that causes the air layer to become close to the suction port 6*a*.

In addition to suppression of the occurrence of the spiral flow caused on the oil level 25, the plate 24 functions as a baffle plate, which prevents the oil level 25 from being waved when the vehicle is turned. In this manner, the plate 24 contributes to preventing air from being sucked through the suction port 6*a*.

Third Embodiment

Figure 8:
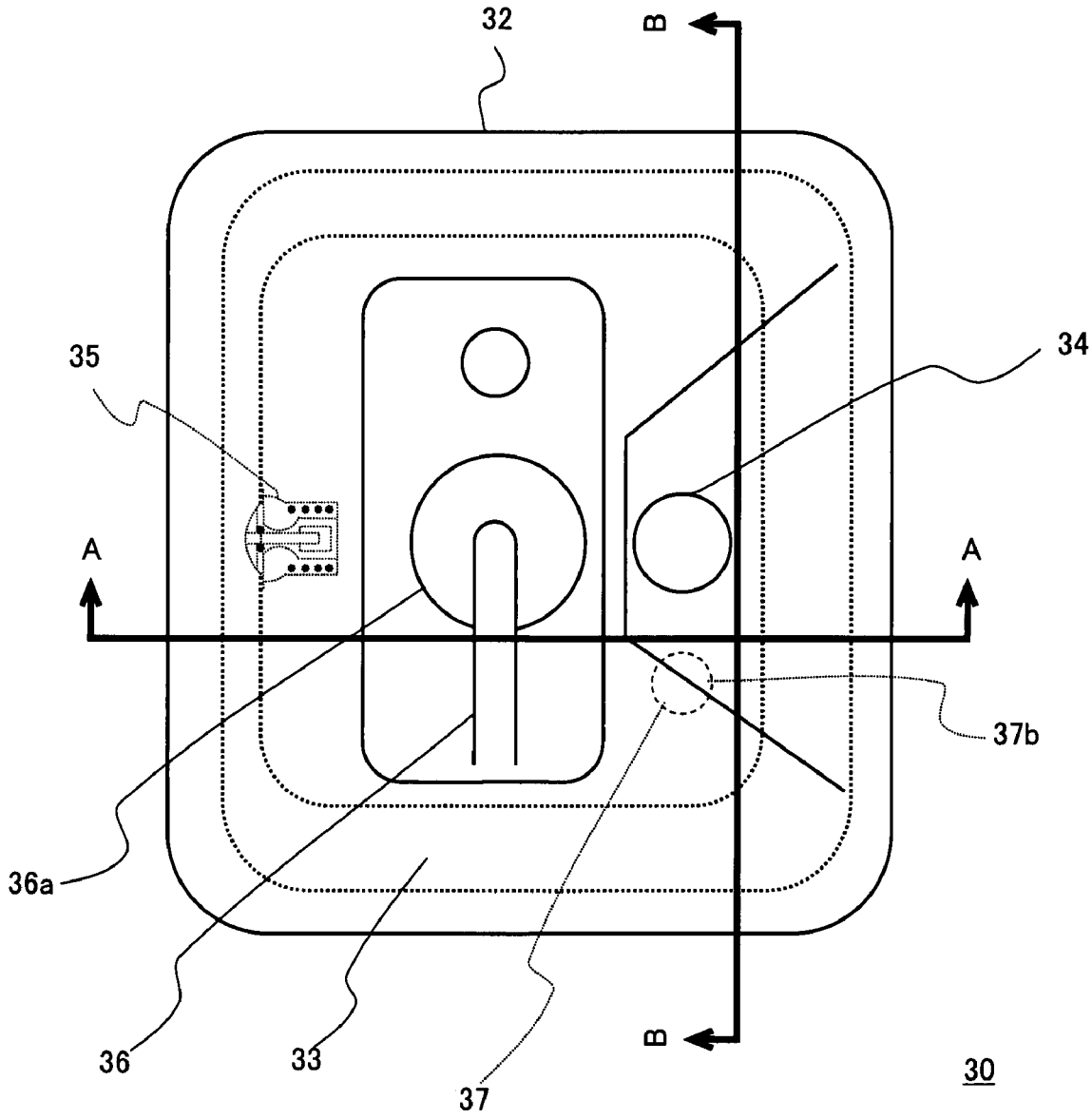
FIG. 8 is a plan view of the dual-chamber oil pan according to a third embodiment of the present invention.
Figure 9:
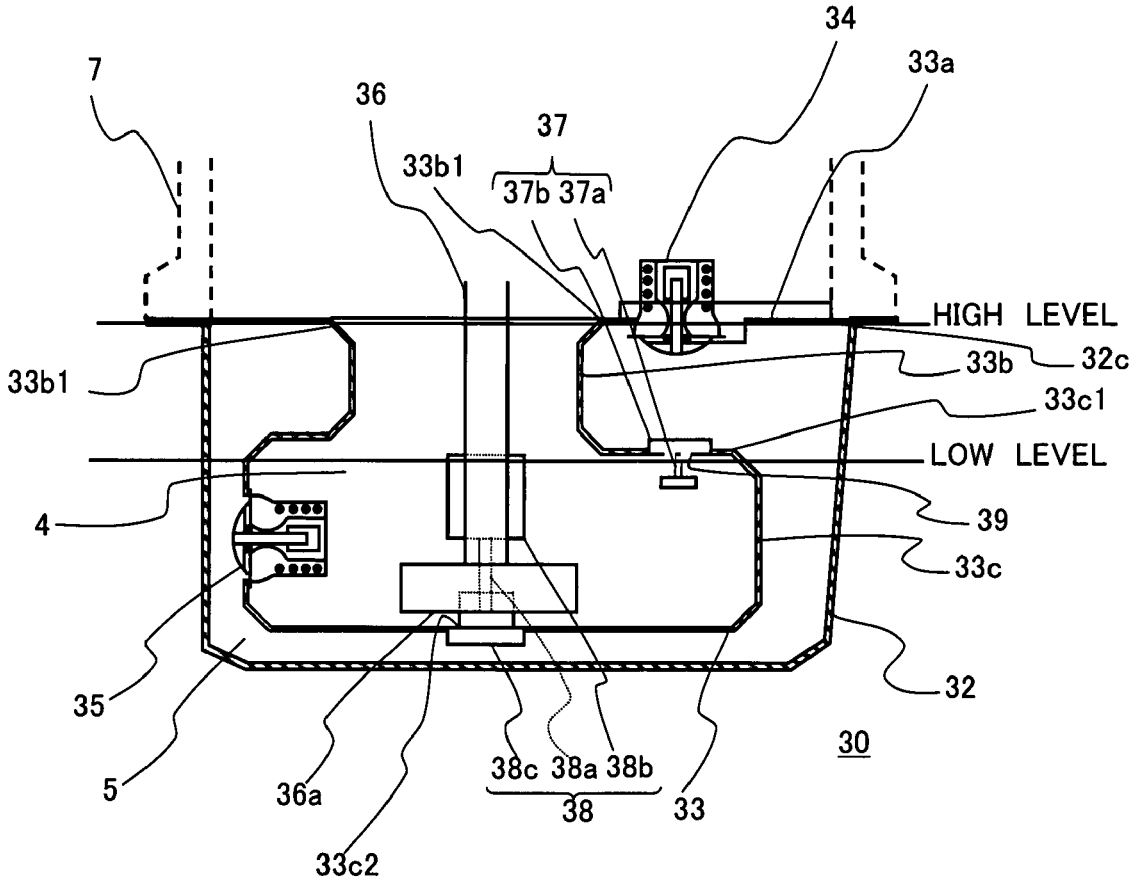
FIG. 9 is a cross-sectional view taken along a line A-A shown in FIG. 8.
Figure 10:
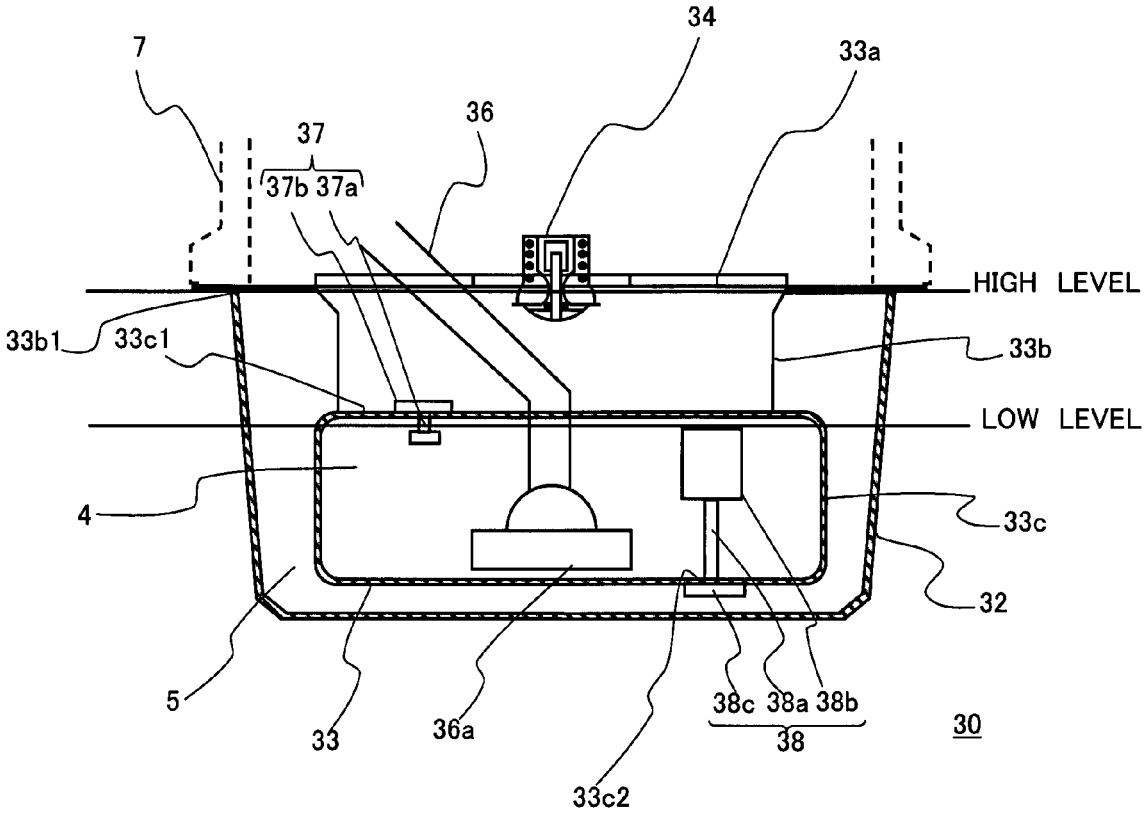
FIG. 10 is a cross-sectional view taken along a line B-B shown in FIG. 8.

A description will now be given, with reference to FIGS. 8 through 10, of a third embodiment of the present invention. FIG. 8 is a plan view of a dual-chamber oil pan 30 in accordance with the third embodiment, and FIG. 9 is a cross-sectional view taken along a line A-A shown in FIG. 8. FIG. 10 is a cross-sectional view taken along a line B-B shown in FIG. 8. Referring to these figures, a dual-chamber oil pan 30 has an oil pan separator 33 provided in an oil pan 32. The oil pan separator 33 divides the inner area of the oil pan 32 into the first chamber 4 communicating with the engine block 7 and the second chamber 5 arranged so as to cover the first chamber 4. This structure of the oil pan separator 33 is the same as that of the dual-chamber oil pan 1 of the first embodiment.

The first chamber 4 includes a large-capacity portion 33*c* provided on the bottom side of the oil pan separator 33, and a small-capacity portion 33*b* that is connected to the large-capacity portion 33*c* and extends upwards. The oil pan separator 33 is equipped with a shoulder portion 33*c*1 formed on the top portion of the large capacity portion 33*c*. The shoulder portion 33*c*1 is formed along the entire circumference of the top portion of the large-capacity portion 33*c*. The oil pan separator 33 has an oil receiving portion 33*a*, which extends from an upper end 33*b*1 of the small-capacity portion 33*b* having a hollow cylindrical shape to a circumferential upper end 32*c* of the oil pan 32. A suction port 36*a* of a strainer 36 is disposed in the first chamber 4. The above-mentioned structures of the third embodiment are also the same as those of the first embodiment.

The oil receiving portion 33*a* is not inclined as much as the oil receiving portion 3*a* of the first embodiment. In FIG. 9, the oil receiving portion 33*a* is the almost level plane. A first thermostat 34 is provided in the oil receiving portion 33*a* in such a manner that a temperature sensitive portion thereof faces the engine block 7. The first thermostat 34 is opened when the engine oil dropped from the engine block 7 is hot. Thus, the engine oil at high temperature can be caused to flow in the second chamber 5 without flowing in the small-capacity portion 33*b* and the large-capacity portion 33*c*.

A second thermostat 35 is provided to the large-capacity portion 33*c* in such a manner that a temperature sensitive portion thereof faces the first chamber 4. The second thermostat 35 is opened when the temperature of the engine oil in the first chamber 4 becomes high. Thus, the first chamber 4 and the second chamber 5 can communicate with each other when the engine oil is at high temperature.

The oil pan separator 33 has the shoulder portion 33*c*1 formed on the top portion of the large-capacity portion 33*c*. An oil port 39 for communicating the first chamber 4 and the second chamber 5 with each other is provided in the shoulder portion 33*c*1. An oil valve 37 is provided to the oil port 39 and opens the oil port 39 as the oil level in the first chamber 4 rises. The oil valve 37 is composed of a rod 37*a* penetrated through the oil port 39, and a flange 37*b* that is provided to the upper end of the rod 37*a* and receives the oil pressure. The oil port 39 levels the oils in the first and second chambers 4 and 5 at the time of oil exchange. The engine oil supplied through the strainer 36 from the engine block 7 at the time of oil exchange is first stored in the first chamber 4. When the oil level reaches the height of the oil port 39, the engine oil lifts the flange 37*b* so that the oil port 39 can be opened. Thus, the engine oil in the first chamber 4 overflows to the second chamber 5, and the oil level in the second chamber 5 increases. When the oil level in the second chamber 5 becomes equal to that in the first chamber 4, the flange 37*b* receives identical oil pressures from the first and second chambers 4 and 5. Thus, the oil valve 37 closes the oil port 39.

An oil drain 33*c*2 is provided to the bottom of the oil pan separator 33. A float valve 38 is provided to the oil drain 33*c*2. The float valve 38 is composed of a rod 38*a*, a float portion 38*b*, and a valve body 38*c*. The rod 38*a* is penetrated through the oil drain 33*c*2. The float portion 38*b* is provided to the top end of the rod 38*a*. The valve body 38*c* is provided to the lower end of the rod 38*a*. The float valve 38 is activated when the engine oil in the first chamber 4 is drawn. A not-shown oil drain attached to the oil pan 32 is released. The engine oil in the second chamber 5 starts to be drawn. When a certain oil level difference is developed between the first and second chambers 4 and 5, the oil pressure in the first chamber 4 is applied to the valve body 38*c*, which depresses the float valve 38. Thus, the oil drain 33*c*2 is released, and the engine oil in the first chamber 4 can be drawn. When the first and second chambers 4 and 5 are full of engine oil, the float valve 38 operates so that the valve body 38*c* closes the oil drain 33*c*2 with the float portion 38*b* being balanced with the oil pressure exerted on the valve body 38*c*.

The minimum oil level height of the dual-chamber oil pan 30 is indicated as "LOW LEVEL" in FIGS. 9 and 10. The large-capacity portion 33*c* has an upper portion higher than the minimum oil level height. It is thus possible to reduce the speed at which the oil level comes close to the suction port 36*a* and to lower the dangerous possibility that air may be sucked from the suction port 36*a*.

The dual-chamber oil pan 30 thus structured can quickly raise the temperature of the engine oil at the time of cold start, and reduces the frictions caused against the individual engine parts. This results in improvement of fuel economy. In addition, the use of the oil port 39 provided to the shoulder portion 33*c*1 facilitates the movement of engine oil to the second chamber 5. In addition, the oil port 39 is provided with the oil valve 37, so that the first and second chambers 4 and 5 can be isolated from each other at the time of cold start.

It can be seen from the above description that the present invention is not limited to the specifically disclosed embodiments, and various modifications thereof and other embodiments may be made within the scope of the present invention. For example, the plate 24 may have another shape or size so that air can effectively be prevented from being sucked via the suction port 6*a*.

Figure 11:
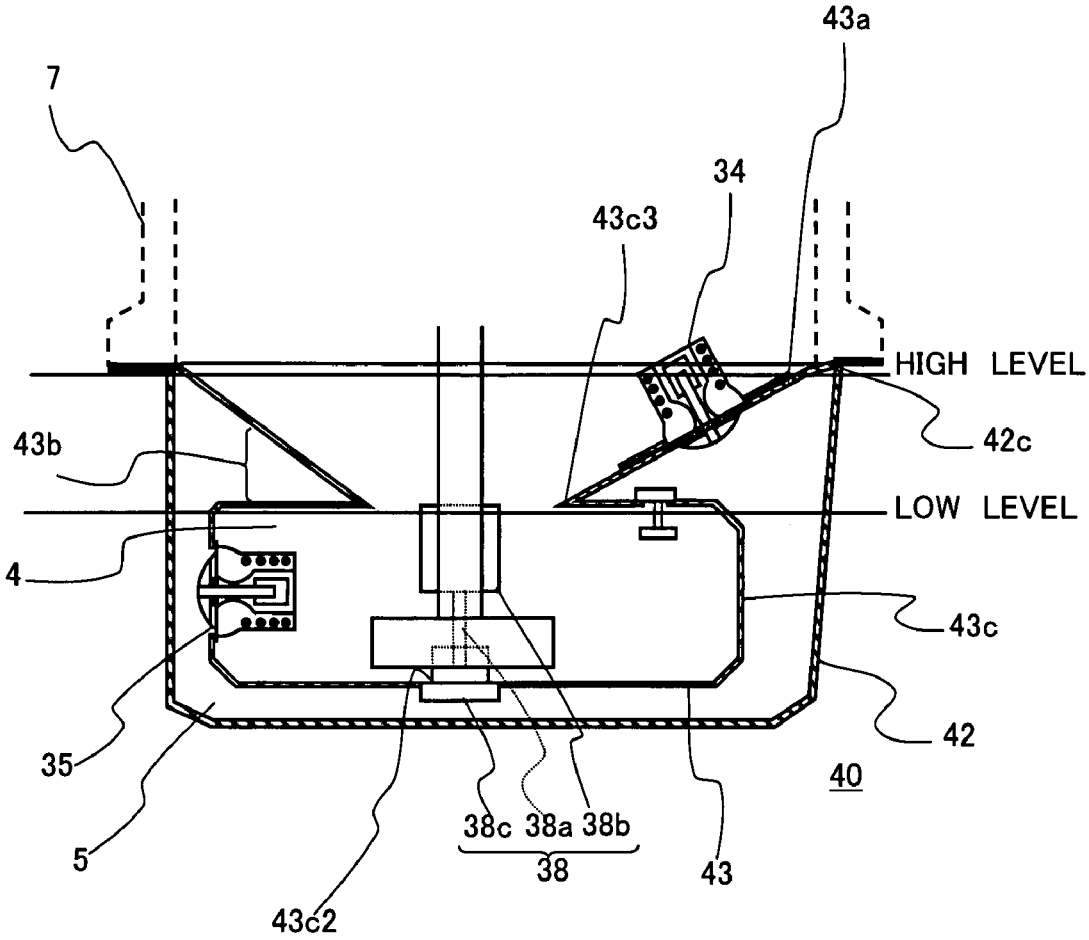
FIG. 11 is a cross-sectional view of a variation of the embodiments of the present invention.

The small-capacity portions may have other shapes. The aforementioned embodiments employ the cylindrical hollow shapes. However, the small-capacity portions may have no cylindrical hollow shape. An exemplary structure is shown in FIG. 11, which a dual-chamber oil pan 40 has an oil pan 42 and an oil pan separator 43 having an oil drain 43*c*2. The oil pan separator 43 defines a large-capacity portion 43*c* having an opening 43*c*3. A constricted portion 43*a* extends from the opening 43*c*3 to a circumferential upper end 42*c* of the oil pan 42. The constricted portion 43*a* is included in an oil receiving portion, which is a down slope provided with the first thermostat 34.

Figure 12:
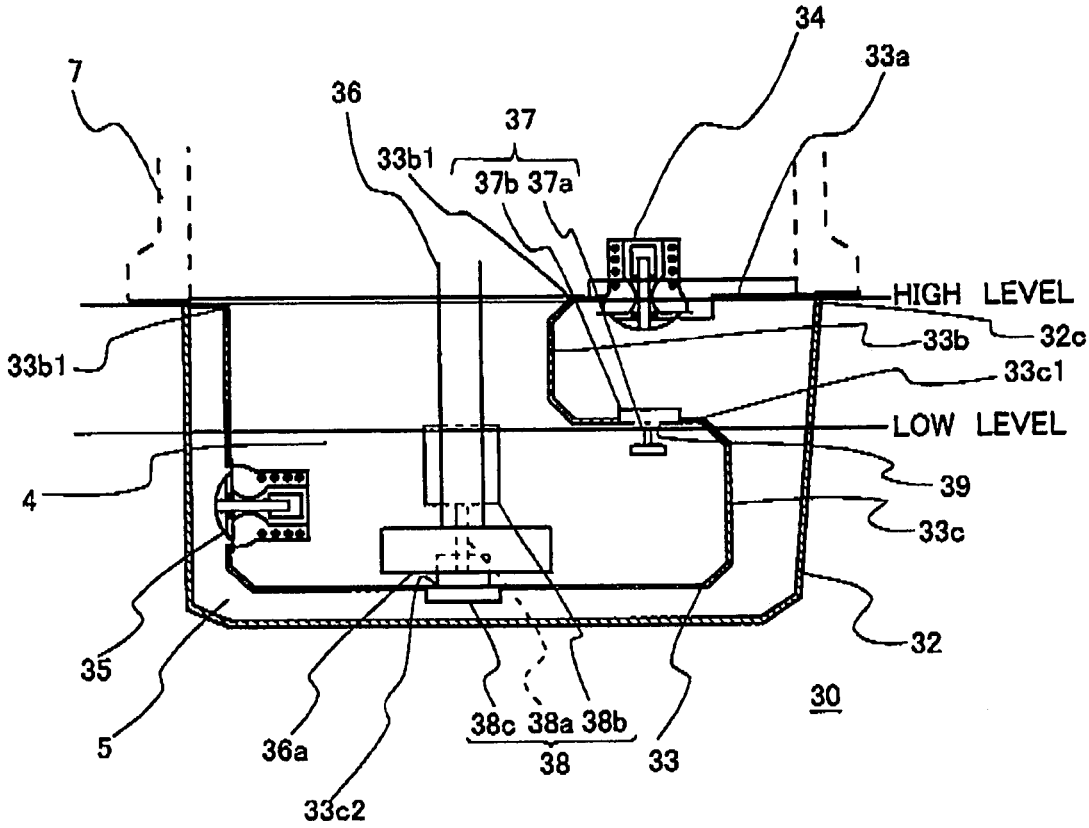
FIG. 12 is a cross-sectional view of a variation of the third embodiment of the present invention.

The shape of the oil pan separator 33 of the dual-chamber oil pan 30 employed in the third embodiment of the present invention may be modified, as shown in FIG. 12. In the oil pan separator 33 shown in FIG. 9, the shoulder portion 33*c*1 is formed along the entire circumference of the top portion of the large-capacity portion 33*c*. In FIG. 12, the shoulder portion 33*c*1 is modified so that a sidewall of the small-capacity portion 33*b* is flush with a sidewall of the large-capacity portion 33*c*. In other words, the shoulder portion 33*c*1 is formed along a part of the entire circumference of the top portion of the large-capacity portion 33*c*.

The invention claimed is:

1. A dual-chamber oil pan comprising:

an oil pan provided below an engine block;

an oil pan separator that is provided within the oil pan and defines a first chamber communicating with the engine block, and a second chamber provided around the first chamber; and a suction port disposed within the first chamber, the first chamber including a first portion including a bottom portion of the oil pan separator, and a second portion located above and integrally formed with the first portion, the first portion having a greater capacity than the second portion, wherein the first portion has a larger oil level area than that of the second portion.

2. The dual-chamber oil pan as claimed in claim 1, wherein the oil pan separator includes an oil receiving portion that extends from the second portion to an upper end of the oil pan.

3. The dual-chamber oil pan as claimed in claim 1, wherein the oil pan separator includes an oil receiving portion includes a down slope portion that extends from the second portion to an upper end of the oil pan.

4. The dual-chamber oil pan as claimed in claim 1, wherein the second portion has a constricted portion that is a slope portion of the oil pan separator extending from an opening provided in an upper portion of the first portion.

5. The dual-chamber oil pan as claimed in claim 1, wherein the oil pan separator has a shoulder portion located above the first portion.

6. The dual-chamber oil pan as claimed in claim 1, wherein the oil pan separator has a shoulder portion that is at least a part of an upper portion of the first portion.

7. The dual-chamber oil pan as claimed in claim 1, wherein the second portion is located at a level higher than a minimum oil level of the oil pan.

8. The dual-chamber oil pan as claimed in claim 1, wherein the first portion has a portion located at a level higher than a minimum oil level of the oil pan.

9. The dual-chamber oil pan as claimed in claim 1, wherein the oil pan separator includes a narrowed portion integrally formed with a lower portion of the first portion, and the suction port is disposed to the narrowed portion.

10. The dual-chamber oil pan as claimed in claim 1, wherein the oil pan separator includes a first communication hole located in the second portion, and a second communication hole located in the first portion.

11. The dual-chamber oil pan as claimed in claim 1, further comprising an oil passage formed between the oil pan separator and the oil pan.

12. The dual-chamber oil pan as claimed in claim 1, further comprising a plate disposed on a pipe of the suction port, the pipe transporting oil sucked from the suction port, wherein the plate is positioned above the suction port.

13. A dual-chamber oil pan comprising:

an oil pan provided below an engine block;

an oil pan separator that is provided within the oil pan and defines a first chamber communicating with the engine block, and a second chamber provided around the first chamber; and a suction port disposed within the first chamber, the first chamber including a first portion including a bottom portion of the oil pan separator, and a second portion located above and integrally formed with the first portion, the first portion having a greater capacity than the second portion, wherein the second portion has a constricted portion that is connected to an opening provided in an upper portion of the first portion and extends upwards.

14. A dual-chamber oil pan comprising:

an oil pan provided below an engine block;

an oil pan separator that is provided within the oil pan and defines a first chamber communicating with the engine block, and a second chamber provided around the first chamber; and a suction port disposed within the first chamber, the first chamber including a first portion including a bottom portion of the oil pan separator, and a second portion located above and integrally formed with the first portion, the first portion having a greater capacity than the second portion, wherein the second portion has a hollow cylindrical portion that is connected to an opening provided in an upper portion of the first portion and extends upwards.

15. A dual-chamber oil pan comprising:

an oil pan provided below an engine block;

an oil pan separator that is provided within the oil pan and defines a first chamber communicating with the engine block, and a second chamber provided around the first chamber; and a suction port disposed within the first chamber, the first chamber including a first portion including a bottom portion of the oil pan separator, and a second portion located above and integrally formed with the first portion, the first portion having a greater capacity than the second portion, and an oil port is provided in a shoulder portion of the first portion, and an oil valve closing the oil port as an oil level in the first chamber becomes high.

16. A dual-chamber oil pan comprising:

an oil pan provided below an engine b1ock;

an oil pan separator that is provided within the oil pan and defines a first chamber communicating with the engine block, and a second chamber provided around the first chamber; and a suction port disposed within the first chamber, the first chamber including a first portion including a bottom portion of the oil pan separator, and a second portion located above and integrally formed with the first portion, the first portion having a greater capacity than the second portion, the dual-chamber oil pan further comprising:

a first thermostat attached to the oil pan separator so that a temperature sensitive portion thereof faces the engine block; and a second thermostat attached to the oil pan separator so that a temperature sensitive portion thereof faces the first chamber.

17. An engine comprising:

an engine block; and a dual-chamber oil pan including:

an oil pan provided below the engine block;

an oil pan separator that is provided within the oil pan and defines a first chamber communicating with the engine block, and a second chamber provided around the first chamber; and a suction port disposed within the first chamber, the first chamber including a first portion including a bottom portion of the oil pan separator, and a second portion located above and integrally formed with the first portion, the first portion having a greater capacity than the second portion, wherein the first portion has a larger oil level area than that of the second portion.

* * * * *